US011132890B2

(12) United States Patent
Gouin

(10) Patent No.: US 11,132,890 B2
(45) Date of Patent: Sep. 28, 2021

(54) FAULT ISOLATION LOCALITY

(71) Applicant: JOHNSON CONTROLS FIRE PROTECTION LP, Boca Raton, FL (US)

(72) Inventor: Alexandre Gouin, Saint-Basile-le-Grand (CA)

(73) Assignee: JOHNSON CONTROLS FIRE PROTECTION LP, Boca Raton, FL (US)

( * ) Notice: Subject to any disclaimer, the term of this patent is extended or adjusted under 35 U.S.C. 154(b) by 0 days.

(21) Appl. No.: 16/413,307

(22) Filed: May 15, 2019

(65) Prior Publication Data

US 2020/0365010 A1 Nov. 19, 2020

(51) Int. Cl.

| | |
|---|---|
| ***G08B 29/00*** | (2006.01) |
| ***G08B 29/04*** | (2006.01) |
| ***G08B 29/14*** | (2006.01) |
| ***G08B 29/12*** | (2006.01) |
| ***G08B 17/06*** | (2006.01) |

(52) U.S. Cl.

CPC ..... *G08B 29/043* (2013.01); *G08B 17/06* (2013.01); *G08B 29/123* (2013.01); *G08B 29/145* (2013.01)

(58) Field of Classification Search

CPC ..... G08B 29/043; G08B 17/06; G08B 29/145

See application file for complete search history.

(56) References Cited

U.S. PATENT DOCUMENTS

| | | | | |
|---|---|---|---|---|
| RE34,643 | E * | 6/1994 | Payne | G08B 26/005 340/505 |
| 5,400,203 | A * | 3/1995 | Tice | G08B 29/06 361/55 |
| 6,100,757 | A * | 8/2000 | Kotzamanis | H03H 11/265 330/149 |
| 6,826,027 | B2 * | 11/2004 | Galgay | H02H 3/08 361/58 |
| 8,675,324 | B2 * | 3/2014 | Noguchi | G08B 26/005 361/63 |
| 9,153,968 | B2 * | 10/2015 | Meah | G08B 25/045 |
| 2004/0057181 | A1 * | 3/2004 | Marino | G08B 29/06 361/100 |
| 2004/0153215 | A1 | 8/2004 | Kearny et al. | |
| 2012/0098517 | A1 | 4/2012 | Esumi et al. | |
| 2012/0293017 | A1 | 11/2012 | Lidsky et al. | |
| 2014/0092505 | A1 | 4/2014 | Norris et al. | |
| 2016/0072269 | A1 | 3/2016 | Esschendal et al. | |
| 2017/0063074 | A1 | 3/2017 | Yasusaka et al. | |
| 2018/0351015 | A1 | 5/2018 | Cheng et al. | |
| 2018/0152015 | A1 | 12/2018 | Hopf et al. | |
| 2019/0089146 | A1 * | 3/2019 | Li | H02H 7/0816 |
| 2019/0199089 | A1 | 6/2019 | Loume et al. | |
| 2020/0059082 | A1 | 2/2020 | Matsushita et al. | |
| 2020/0366079 | A1 | 11/2020 | Telefus et al. | |

* cited by examiner

*Primary Examiner* — Phung Nguyen

(74) *Attorney, Agent, or Firm* — Arent Fox LLP

(57) ABSTRACT

In an aspect, a fire detection system is described. The first detection system may include isolation circuit having an isolation switch coupled with a system line of the fire detection system and configured to isolate a first side of the system line from a second side of the system line. The isolation circuit may also include a controller coupled with the isolation switch which determines a time delay for determining to isolate the first side from the second side.

16 Claims, 4 Drawing Sheets

FAULT ISOLATION LOCALITY

BACKGROUND

The present disclosure relates generally to fire detection and alarm systems, and more particularly, to fault isolation locality by fire detection and alarm systems.

Typically, fire detection and alarm systems require some type of isolation between different zones (e.g., different floors and/or rooms) of a building. Isolation requirements may allow detection and alarm devices in a first zone to remain enabled and provide continued functionality despite a second zone being isolated due to a detection of a fire or short circuit in the second zone. Isolation of different zones may be accomplished by either separately wiring each zone or by adding isolation circuits to a system having all zones on the same wiring. Isolation circuits may provide lower installation costs (e.g., due to less wiring and labor) and may reduce an overall size of a fire detection and alarm system, as compared to separately wiring each zone. In a typical fire detection and alarm system having a plurality of isolation circuits, when a short circuit occurs on a system line, each isolation circuit opens a switch thereby isolating all zones of the system from each other. When bringing the system back online, the isolation circuits close respective switches one-by-one, starting with the isolation circuit closest to a detection and alarm control unit which may cause undue delay in bringing the system back online. Accordingly, improvements are desired in fire detection and alarm systems having isolation circuits.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

The present disclosure provides systems, apparatuses, and methods for isolating zones in a fire detection system.

In an aspect, an isolation circuit of a fire detection system is described. The isolation circuit may include an isolation switch coupled with a system line of the fire detection system and configured to isolate a first side of the system line from a second side of the system line. The isolation circuit may also include a controller coupled with the isolation switch. The controller may be configured to detect a short circuit on the system line. The controller may also be configured to determine a time delay to open the isolation switch based on the short circuit. The controller may further be configured to control the isolation switch to isolate the first side from the second side based on the time delay.

In another aspect, a method for zone isolation by a fire detection device is described. The method may include detecting a short circuit on a system line of the fire detection system. The method may also include determining a time delay to open an isolation switch of the fire detection system based on the short circuit, the isolation switch coupled with the system line and configured to isolate a first side of the system line from a second side of the system line. The method may further include controlling the isolation switch to isolate the first side from the second side based on the time delay.

In another aspect, a computer-readable medium storing computer executable code for zone isolation by a fire detection system is described. The computer-readable medium may include code to detect a short circuit on a system line of the fire detection system. The computer-readable medium may also include code to determine a time delay to open an isolation switch of the fire detection system based on the short circuit, the isolation switch coupled with the system line and configured to isolate a first side of the system line from a second side of the system line. The computer-readable medium may further include code to control the isolation switch to isolate the first side from the second side based on the time delay. In an example, the computer-readable medium may be a non-transitory computer-readable medium.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

BRIEF DESCRIPTION OF THE DRAWINGS

The disclosed aspects will hereinafter be described in conjunction with the appended drawings, provided to illustrate and not to limit the disclosed aspects, wherein like designations denote like elements, and in which.

DETAILED DESCRIPTION

Figure 1:
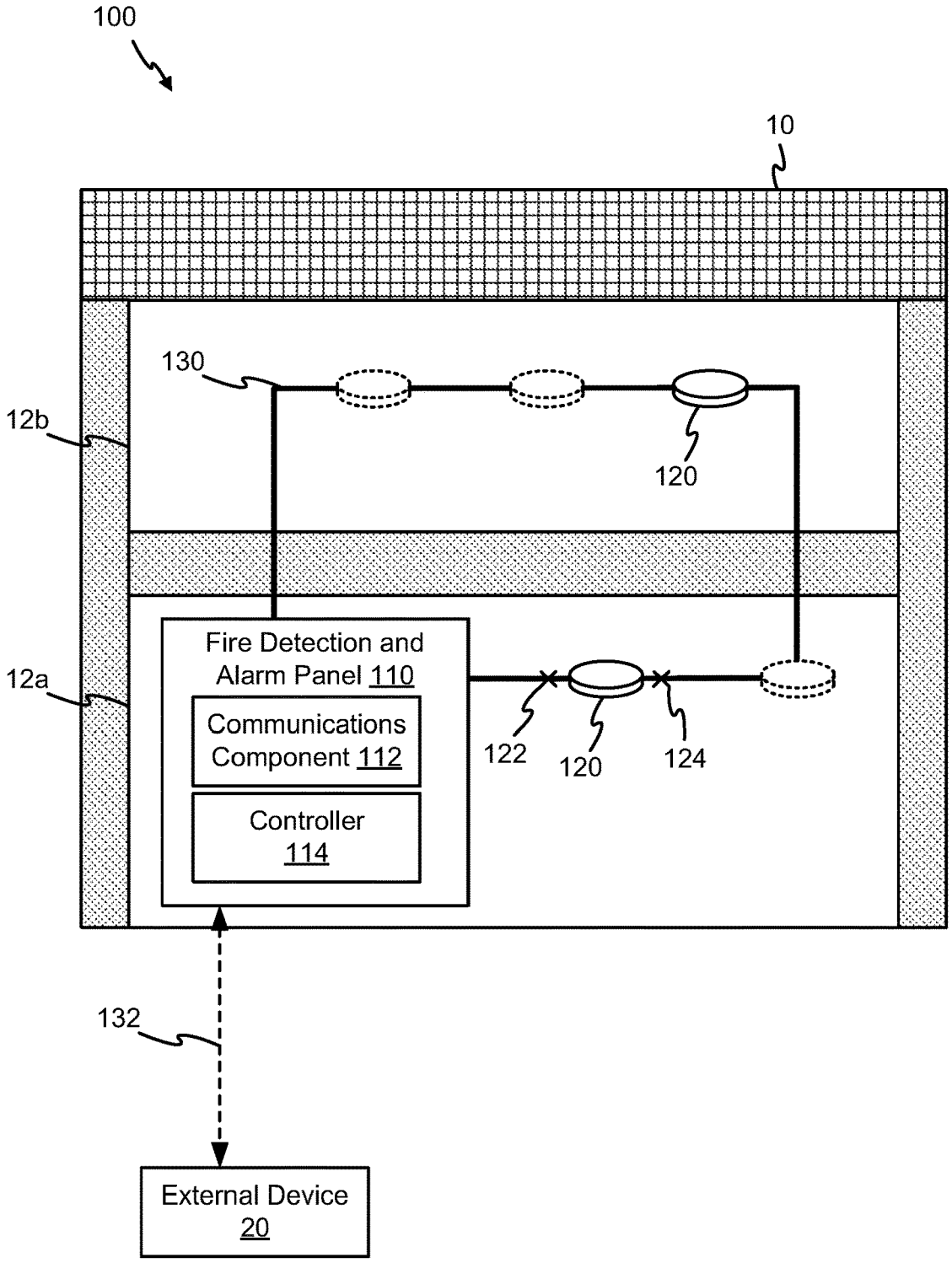
FIG. 1 is a block diagram of an example fire detection system, according to aspects of the present disclosure.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known components may be shown in block diagram form in order to avoid obscuring such concepts.

As described herein, typical fire detection and alarm systems open all isolation circuits in the system when a short circuit is detected, and may lead to undue delay caused by the one-by-one closing of each of the isolation circuits in the system.

Aspects of the present disclosure provide systems, methods, and computer-readable medium for zone isolation that may overcome the above-described limitations of typical short-circuit isolators by using multiple data sources in order to focus on correct and incorrect boundaries in the functioning of a fire detection and alarm system and a timer used to determine a time delay before an isolator switch is to be opened. In an example, an isolation circuit closest to a detected short circuit would have a time delay that is shorter than a time delay of an isolation circuit that is further away from the short circuit. In an example, aspects of the present disclosure, assume that the closest an isolator circuit is to a short circuit, the faster the isolation circuit will open (i.e., isolate). Accordingly, a second isolator circuit, that is upstream from a first isolator circuit closest to the short circuit, may have a respective time delay that expires mere microseconds after a time delay of the first isolator circuit. As such, each isolator circuit may validate that a short circuit is still present on a system line until the very last moment of a respective time delay. If the short circuit is not present once the time delay of the second isolator circuit has expired, this may mean that the first isolation circuit isolated (i.e., opened) prior to the expiration of the time delay of the second isolator circuit, and so the second isolator circuit does not need to isolate the system line.

Accordingly, aspects of the present disclosure may prevent all of the isolation circuits in a fire detection and alarm system from being opened and may allow for a fast recovery of the fire detection and alarm system, as compared to the recovery time of a typical detection and alarm system. Further, aspects of the present disclosure allow devices in non-isolated zones to continue to function normally during, for example, a fire, while the fire detection and alarm system attempts to correct isolation issues in the isolated zones.

Turning now to the figures, example aspects are depicted with reference to one or more components described herein, where components in dashed lines may be optional.

Referring to FIG. 1, a fire detection and alarm system 100 for a building 10 is disclosed. The building 10 may include two or more areas (e.g., rooms or floors) on separate detection and alarm zones. As shown by FIG. 1, the building 10 may include detection and alarm zones 12*a*, 12*b*. However, aspects of the present disclosure are not limited to two zones and instead may include two or more zones. The detection and alarm system 100 may include a fire detection and alarm panel 110 communicatively coupled with one or more detection devices 120 and configured to receive information from the detection devices 120. Examples of the detection devices 120 may include a smoke detector, a heat detector, or any other type of device for detecting fire and/or smoke.

The fire detection and alarm panel 110 may include a communications component 112 configured to communicate with the one or more detection devices 120 and/or one or more external devices 20. Examples of the external device 20 may include an emergency dispatch system (e.g., fire dispatch or police dispatch), a mobile device such as a cellular phone, a smart phone, a personal digital assistant (PDA), a smart speaker, a computer, or an Internet of Things (IoT) device, a landline phone, or any other device capable of receiving communications including text, talk, and/or data communications.

In an aspect, the communications component 112 may communicate with the one or more detection devices 120 via a system line 130, which may be a wired communications link. As shown by FIG. 1, the system line 130 may form a device loop (e.g., all devices, appliances, and/or panels of the detection and alarm system 100 coupled together in a loop). In an aspect the system line may carry power and/or communications between devices, appliances, and/or panels coupled with the device loop. Accordingly, in some aspects, one or more of the fire detection and alarm panel 110 or the detection devices 120 may include circuits referred to as data communication links (DCLs) or signaling line circuits (SLCs) which present communications on the system line 130.

The communications component 112 may communicate with the external devices 20 via one or more communications links 132, which may be one or more of a wired communications link or a wireless communications link. In an example, the communications component 112 may include one or more antennas, processors, modems, radio frequency components, and/or circuitry for communicating via a wireline and/or wirelessly with the detection devices 120 and/or the external devices 20.

The fire detection and alarm panel 110 may also include a controller 114 configured to receive information from the one or more detection devices 120 and to determine whether to communicate with the external device 20. Suitable examples of the controller 114 may include, but are not limited to, a processor or plurality of processors in communication with a memory storing computer-readable instructions executable by the processor to perform the control functions described herein. For example, based on communications from one or more of the detection devices 120, the controller 114 may determine to execute instructions for the communications component 112 to alert a local fire or police department, via the external device 20, about a fire.

While the fire detection and alarm system 110 is shown in FIG. 1 as being located in a first zone 12*a* of the building 10, aspects of the present disclosure do not limit a location of the fire detection and alarm system 110 to this location. For example, the fire detection and alarm system 110 may be located within any zone (e.g., 12*a* or 12*b*) of the building 10 or external to the building 10.

As shown by FIG. 1, each of the zones 12*a*, 12*b* may include one or more detection devices 120 which are configured to detect a short circuit and determine whether to isolate a zone corresponding to the short circuit based on the detection. A detection device 120 may couple with a first connection point 122 and a second connection point 124 of the system line 130. The first connection point 122 and the second connection point 124 may be locations where wiring of the detection device 120 physically connects to wiring of the system line 130. While FIG. 1 illustrates the first connection point 122 and the second connection point 124 being located exterior to the detection device 120, aspects of the present disclosure are not limited to this location as the first connection point 122 and the second connection point 124 may be located on an interior of the detection device 120. Further details on the detection device 120 are described by FIG. 2.

Figure 2:
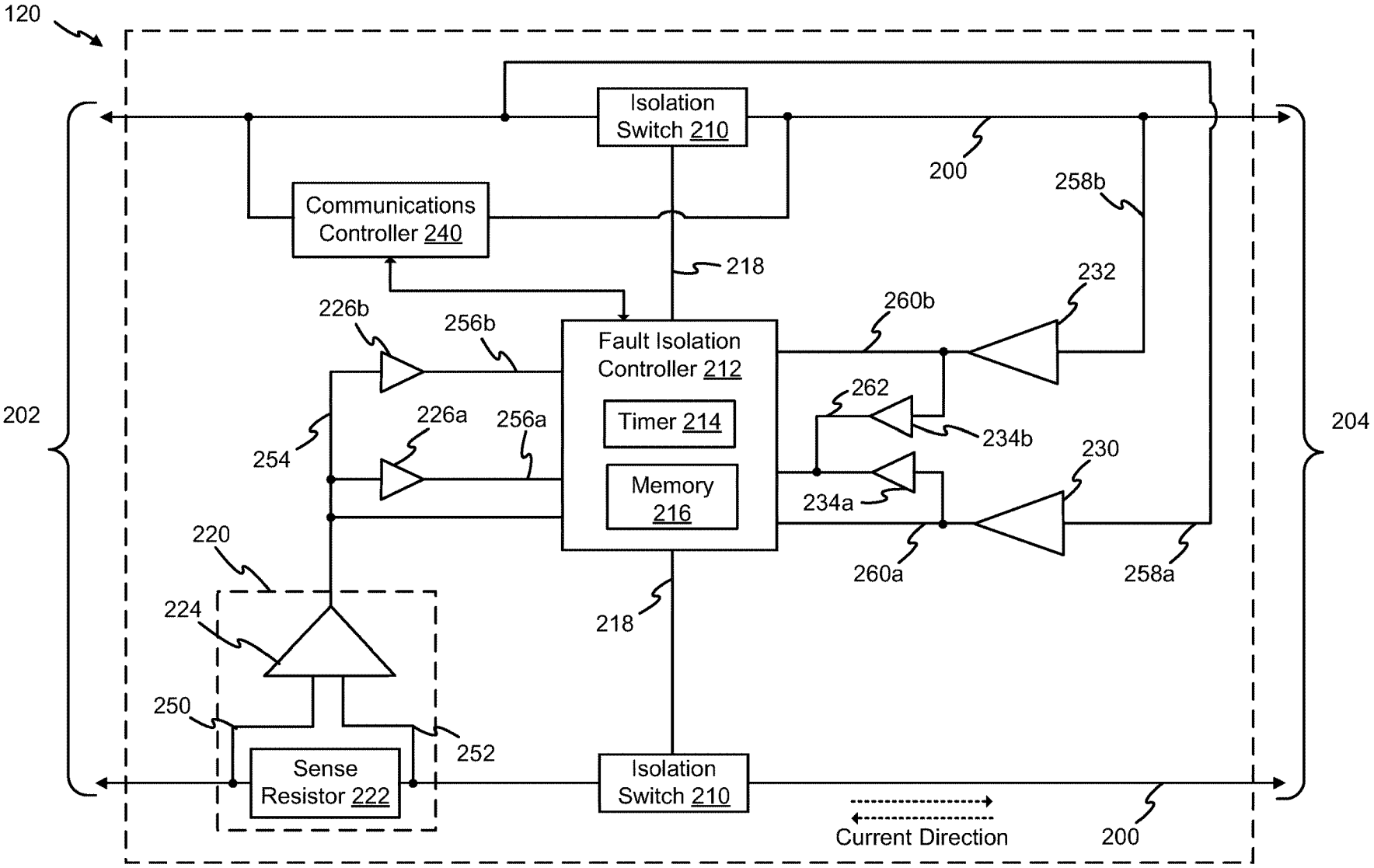
FIG. 2 is a block diagram of an example detection device, according to aspects of the present disclosure.

Referring to FIG. 2, the detection device 120 may include connection interfaces 202, 204 for coupling the detection device 120 with the system line 130, such as at the first connection point 122 and the second connection point 124 (not shown; see FIG. 1). Within the detection device 120, the connection interface 202 may couple with the connection interface 204 via the connection line 200. As voltage and current on the connection line 200 are the same as (or representative of) voltage and current on the system line 130, the connection line 200 may be interchanged with the system line 130 throughout the description of the detection device 120.

In an aspect, the detection device 120 may be bidirectional, meaning the first connection point 122 of the system line 130 may couple with the connection interface 202 and the second connection point 124 of the system line 130 may connect to the connection interface 204 or, alternatively, the first connection point 122 of the system line 130 may couple with the connection interface 204 and the second connection point 124 of the system line 130 may couple with the connection interface 202.

The detection device 120 may include one or more isolation switches 210 coupled with the connection line 200. The isolation switches 210 may be configured to open based on a detection of a short circuit on the system line 130. Once opened, the isolation switches 210 may electronically isolate the connection interface 202 from the connection interface 204. In an aspect, the isolation switches 210 may also be coupled with a fault isolation controller 212 via a switch control line 218 and be controlled (e.g., opened or closed) by the fault isolation controller 212. For example, the isolation switches 210 may receive a logic level signal from the fault isolation controller 212 via the switch control line 218 to open or close the isolation switches 210. In an example, the logic level signal may be a transistor-transistor logic (TTL) signal or complementary metal-oxide-semiconductor (CMOS) logic level signal. Examples of the isolation switches 210 may include a field-effect transistor (FET) such as a metal-oxide-semiconductor (MOSFET) or junction FET (JFET), a relay such as an electro-magnetic relay, or any other type of electronic or electro-mechanical switch.

The detection device 120 may also include the fault isolation controller 212 coupled with a current monitor 220 and voltage monitors 230, 232. The current monitor 220 may be configured to monitor current on the connection line 200 and to provide an output signal (current level signal) corresponding to the current of the connection line 200 to the fault isolation controller 212. In an example, the current monitor 220 may include two input signal lines 250, 252 coupled with the connection line 200 and an output signal line 254 coupled with the fault isolation controller 212. The current monitor 220 may include a current sense amplifier 224 coupling with the two input signal lines 250, 252. The current monitor 220 may also include a sense resistor 222 coupled with the connection line 200 between the two input signal lines 250, 252. The current sense amplifier 224 may be configured to measure the current on the connection line 200 based on the sense resistor 222, and to provide a signal (current level signal) on the output signal line 254 to the fault isolation controller 212. The signal on the output signal line 254 may be a voltage representative of the detected current on the connection line 200. In an example, when a short circuit occurs on the system line 130, the current monitor 220 may detect a change in the current along the connection line 200 thereby an output signal (e.g., output in voltages) of the current monitor 220 may change based on the change in current. For example, a normal output signal on the output signal line 254 may be at a baseline voltage (e.g., 2.5 volts (V)), and when a voltage on the output signal line 254 increases (e.g., towards 5V) or decreases (e.g., towards 0V), the change in the voltage on the output signal line 254 is representative of the change in the current on the connection line 200.

For example, when a short circuit occurs on the system line 130, the current detected by the current monitor 220 may increase resulting in the output signal (e.g., a voltage level) on the output signal line 254 to increase/decrease depending on a location of the short circuit. For example, if a short circuit occurs on the side of the communication interface 202, the current on the detection line 200 may increase in the direction of the communication interface 204 towards the communication interface 202 (e.g., right to left in FIG. 2), and if a short circuit occurs on the side of the communication 204, the current on the detection line 200 may increase in the direction of the communication interface 202 towards the communication interface 204 (e.g., left to right in FIG. 2).

Further, a normal output signal of the current monitor 220 may be at a baseline voltage (e.g., 2.5V). Accordingly, when the voltage on the output signal of the current monitor 220 increases from the baseline voltage (e.g., increases from 2.5V towards 5V), this may indicate a short circuit on the side of the communication interface 204 (i.e., current increase in direction of the communication interface 202 towards the communication interface 204), and when the voltage on the output signal of the current monitor 220 decreases from the baseline voltage (e.g., decreases from 2.5V towards 0V), this may indicate a short circuit on the side of the communication interface 202 (i.e., current increase in the direction of the communication interface 204 towards the communication interface 204).

In an aspect, the detection device 120 may also include one or more current comparators 226*a* and/or 226*b*. The current monitor 220 may be coupled with the current comparators 226*a* and/or 226*b* via the output signal line 254, as shown by FIG. 2. The current comparators 226*a*, 226*b* may be configured to receive an output signal of the current monitor 220, compare the output signal to one or more current thresholds, and provide a wake-up signal and an indication of which side of the detection device 120 a short circuit occurred on the system line 130 to the fault isolation controller 212 based on the comparison. In an example, the one or more current thresholds may include a reference voltage received by the current comparators 226*a*, 226*b*. system line For example, the current comparator 226*a* may receive an output signal of the current monitor 220 via the output signal line 254 and compare the output signal of the current monitor 220 to a first current threshold (e.g., 3.566V). If the output signal of the current monitor 220 is greater than the first current threshold, the current comparator 226*a* may send a first current alert signal on the current alert line 256*a* to the fault isolation controller 212. In an example, the first current alert signal from the current comparator 226*a* may trigger the fault isolation controller 212 to change from a sleep mode to an awake mode. Further, since the current comparator 226*a* triggered the fault isolation controller 212, the first current alert signal may also be an indication to the fault isolation controller 212 that a short circuit occurred on the side of the communication interface 204 based on an increase in current from the communication interface 202 to the communication interface 204 on the detection line 200.

In another example, the current comparator 226*b* may receive an output signal of the current monitor 220 via the output signal line 254 and compare the output signal of the current monitor 220 to a second current threshold (e.g., 1.43V). If the output signal of the current monitor 220 is less than the second current threshold, the current comparator 226*b* may send a second current alert signal on the current alert line 256*b* to the fault isolation controller 212. In an example, the second current alert signal may trigger the fault isolation controller 212 to change from a sleep mode to an awake mode. Further, since the current comparator 226*a* triggered the fault isolation controller 212, the second current alert signal may be an indication to the fault isolation controller 212 that a short circuit occurred on the side of the communication interface 202 based on an increase in current from the communication interface 204 to the communication interface 202 on the detection line 200.

The voltage monitors 230, 232 may be configured to monitor voltage on the system line 130 via connection line 200, and provide voltage output signals to the fault isolation controller 212. In an aspect, input lines 258*a*, 258*b* of the voltage monitors 230, 232 may couple with the connection lines 200 and output lines 260*a*, 260*b* of the voltage monitors 230, 232 may couple with the fault isolation controller 212. The voltage monitor 230 may monitor voltage on the system line 130 at the connection interface 202 side of the detection device 120, and the voltage monitor 232 may monitor voltage on the system line 130 at the connection interface 204 side of the detection device 120.

In an aspect, the detection device 120 may also include one or more voltage comparators 234*a* and/or 234*b*. As shown by FIG. 2, the voltage comparators 234*a*, 234*b* may receive the output signals on output lines 260*a*, 260*b* of the voltage monitors 230, 232, respectively. The voltage comparators 234*a*, 234*b* may then compare the received signal of one or more of the output lines 260*a*, 260*b* to a voltage threshold. Further, based on the voltage comparison, the voltage comparators 234*a*, 234*b* may provide a voltage alert signal on a voltage alert line 262 coupled with the fault isolation controller 212 to indicate a voltage level on the connection interface 202 side and/or on the connection interface 204 side does not satisfy the voltage threshold. For example, when a short circuit is on the system line 130, the voltage level on the output signals of one or more of the output lines 260*a*, 260*b* may be below the voltage threshold. As shown by FIG. 2, outputs of the voltage comparators 234*a*, 234*b* may be tied together.

As described herein, the fault isolation controller 212 may couple with output lines of the current monitor 220, the voltage monitors 230, 232, the current comparators 226*a*, 226*b*, and the voltage comparators 234*a*, 234*b*. In an example, the output lines of the current monitor 220 and the voltage monitors 230, 232, may couple with analog to digital conversion (ADC) pins of the fault isolation controller 212 and outputs of the current comparators 226*a*, 226*b* and the voltage comparators 234*a*, 234*b* may couple with alert or interrupt pins.

The fault isolation controller 212 may contain instructions or logic to open (e.g., isolate communication interface 202 from communication interface 204) or close (e.g., communicatively couple communication interface 202 with communication interface 204) the isolation switches 210 based on output signals received from the current monitor 220, the voltage monitors 230, 232, the current comparators 226*a*, 226*b*, and the voltage comparators 234*a*, 234*b*. In an example, the instructions or logic may be stored in memory 216 of the fault isolation controller 212. The fault isolation controller 212 may read the output signal from the current monitor 220 and the output signals from the voltage monitors 260*a*, 260*b*, determine whether an actual short circuit is on the system line 130 or not, and, based on the determination, may control the isolation switches 210 to be opened or closed.

In some examples, the fault isolation controller 212 may receive an indication of the short circuit via one or more of the current monitor 220, the voltage monitors 230, 232, the current comparators 226*a*, 226*b*, or the voltage comparators 234*a*, 234*b*. For example, the fault isolation controller 212 may receive an indication of the short circuit from the current comparators 226*a*, 226*b* via the current alert lines 256*a*, 256*b*, respectively, or from the voltage comparators 234*a*, 234*b* via the voltage alert line 262. In another example, the fault isolation controller 212 may receive an indication of the short circuit based on the current level signal received from the current monitor 220 via the output signal line 254, or based on the voltage level signal received from the voltage monitors 230, 232 via voltage output lines 260*a*, 260*b*.

Once the indication of the short circuit is received, the fault isolation controller 212 may read the output signal from the current monitor 220 and the output signals from the voltage monitors 260*a*, 260*b* and determine whether or not an actual short circuit is on the system line 130. In some examples, the fault isolation controller 212 may compare the current level signal and the voltage level signal to one or more detection thresholds (including current detection thresholds and voltage detection thresholds) to determine whether or not an actual short circuit is on the system line 130. In an example, the one or more detection thresholds may represent current and/or voltage of a normal load on the system line 130. In an example, one or more of the detection thresholds may be a value stored in the memory 216 and may be based on one or more of a typical line voltage, a permitted line length, or permitted line loading devices.

For example, the fault isolation controller 212 may determine that a short circuit is on the system line 130 based on the current level signal indicating that a current level is greater than a first current detection threshold (e.g., 0.45 Amps). In another example, the fault isolation controller 212 may determine that a short circuit is on the system line 130 based on a detection of an abnormal impedance when the current level signal indicates that the current level is less than the first current detection threshold (e.g., 0.45 Amps) but greater than a second current detection threshold (e.g., 0.35 Amps) and a voltage level signal indicates a voltage level is less than a first voltage detection threshold (e.g., 14V) and more than a second voltage detection threshold (e.g., 8.8V). In another example, the fault isolation controller 212 may determine that a short circuit is on the system line 130 based on an open wiring fault when the current level signal indicates that the current voltage level is less than the second current detection threshold (e.g., 0.35 Amps) and the voltage level signal indicates that the voltage level is less than the second voltage detection level (e.g., 8.8V).

Because the fault isolation controller 212 relies on both current and voltage to determine whether a short circuit occurred on the system line 130, the detection device 120 is able to be more robust than devices that only monitor a single input. For example, in comparison with a typical detection device, the detection device 120 may distinguish between an actual short circuit and false positives/negatives (e.g., due to communications on system line 130).

Based on the determination of a short circuit, the fault isolation controller 212 may open or close the isolation switches 210. As an example, the fault isolation controller 212 may send a control signal, such as a TTL signal or CMOS logic level signal, corresponding to opening or closing the isolation switches 210. In an aspect, the control signal may be sent via switch control line 218.

In some aspects, the fault isolation controller 212 may include a timer 214 for providing time for the detection device 120 to determine whether to open the isolation switches 210. In an example, the fault isolation controller 212 may determine a time delay for opening the isolation switches 210. In an example, the fault isolation controller 212 waits for the timer to expire because the fault isolation controller 212 assumes that the closest an isolation circuit is to a short circuit, the faster the isolation circuit will open. As an example, a second isolation circuit that is located further away from short circuit than a first isolation circuit may have a time delay that is mere microseconds after a time delay of the first isolation circuit. As such it is important for each of the isolation circuits to validate that the short circuit is still present until the very last moment of a respective time delay. If the short circuit is not present, it can mean that the first isolation circuit opened isolation switches prior to the second isolation circuit, and therefore the second isolation circuit does not need to open isolation switches.

In an aspect, the time delay may be based on an input received from one or more of the current monitor 220, the voltage monitors 230, 232, the current comparators 226*a*, 226*b*, or the voltage comparators 234*a*, 234*b*. For example, the time delay may be calculated based on one or more of the current level signal or the voltage level signal (Vadc-bits) read by the fault isolation controller 212. The Vadc-bits value may be multiplied by a differentiation timing coefficient (e.g., 6 μs) and/or added to an offset (e.g., 200 μs) (e.g., Vadc-bits*differentiation timing coefficient+offset) to obtain the time delay.

In an example, the offset is a minimum time required to make one round of voltage/current ADC readings by each of the detection devices 120 on the system line 120. The offset may be based on code computation speed, clock frequency, and/or global state machine algorithms used by each of the detection devices 120.

In an example, the differentiation timing coefficient may be based on (a) a maximum number of permitted isolating devices (e.g., detection devices 120) in series on the system line 130, and (b) a maximum resolution time allowed for isolator switches 210 to resolve a short circuit before other detection devices 120 lose power. For example, a first detection device 120 closest to the short circuit would see 0 bits-Vadc and a second detection device 120 next to the first detection device 120 would see 1024 bits-Vadc. Therefore, if a maximum number of detection devices 120 in series is 50 and a maximum resolution time is 6 ms, then 6 ms/1024=5.86 μs/bit, which may be rounded to the closest integer, 6 μs. Accordingly, the differentiation between two isolators (e.g., detection devices 120) next to each other is high enough to provide a somewhat precise localization based on: (a) a minimum impedance of wiring between the two isolators (which may be based on building code and a permitted wire gauge) and (b) each isolator's own series (through and through) resistance. In an example, 0.25 ohm*0.35 A may yield a 0.087 V differentiation, or 2.4 bits thus 12 μs difference.

In another example, the time delay may be determined based on values in a look up table (LUT) stored in the memory 216. For example, the LUT may include a number of time delays values with corresponding ranges of one or more of current levels or the voltage levels. To determine the time delay, the fault isolation controller 212 may read one or more of the current level signal or the voltage level signal, compare the read value to the ranges stored in the LUT, and obtain a time delay value corresponding to the read value.

In another example, the time delay may be a hardcoded value based on a location of the detection device 120 on the system line 130. Based on this example, the further in distance that the detection device 120 is from the fire detection and alarm panel 110, the shorter the time delay would be. In some examples, the time delay may be hardcoded by having each of the detection devices 120 on the system line 130 manufactured with different time delays preprogrammed and installed according to the time delay (i.e., the detection device 120 with the shortest time delay would be installed furthest away from the fire detection and alarm panel 110 and the detection device 120 with the longest time delay would be installed closest to the fire detection and alarm panel 110). In some examples, the time delay may be selected and hardcoded during installation such that the detection devices 120 are installed according to the time delay.

In some examples, the time delay may be selected based on a multiple of the address set via a dual in-line package (DIP) switch (e.g., address1*differentiation timing coefficient, address2*differentiation timing coefficient, etc). In this example, each addresses would need to be set according to placement of the detection device 120 on the system line 130.

In some examples, the time delay may be determined through after-installation calibration, where system line 130 (having all detection devices 120 installed) would be subjected to a worst case short and forced to isolate in a special mode. In this case, the calibration would serve in affecting each isolation switch 210 a hardcoded time delay based on when they perform a verification of the system line 130 after isolation. The detection devices 120 performing the calibration first would be deemed further from the short circuit from this moment on, and would store a long time delay value.

In some examples, the time delay may be determined based on communications between the fire detection and alarm panel 110 and each of the detection devices 120. For example, the communication controller 240 of each detection device 120 may be used to sequentially affect a time delay based on an order with which the fire detection and alarm panel 110 initially talks to each of the detection devices 120. As an example, since the detection devices 120 can isolate, each of the detection devices 120 may be isolated and every address tested. The first device of the detection devices 120 to correctly answer to the fire detection and alarm panel 110 would be deemed closest to the fire detection and alarm panel 110 and would receive from the fire detection and alarm panel 110 a longest time delay value and could store this value. Remaining detection devices 120 would receive time delay values according to position on the system line 130.

In some aspects, the fault isolation controller 212 may transition from a sleep mode to an awake mode based on received alert signals from the current comparators 226*a*, 226*b* and/or the voltage comparators 234*a*, 234*b*. For example, the fault isolation controller 212 may conserve power by resorting to a sleep mode until the fault isolation controller 212 receives an alert signal from either the current comparators 226*a*, 226*b* and/or the voltage comparators 234*a*, 234*b*. The alert signal may function as an indication of a potential short circuit on the system line 130 and a wake-up signal to the fault isolation controller 212.

As described herein, the current comparators 226*a*, 226*b* may indicate to the fault isolation controller 212 which side of the detection device 120 a short circuit occurred on the system line 130 (e.g., communication interface 202 side or communication interface 204 side). For example, when the fault isolation controller 212 receives a current alert signal from the current comparator 226*a*, the fault isolation controller 212 may determine that a short circuit occurred on the communication interface 204 side. In another example, when the fault isolation controller 212 receives a current alert signal from the current comparator 226*b*, the fault isolation controller 212 may determine that a short circuit occurred on the communication interface 202 side.

In an aspect, the detection device 120 may include a communications controller 240 configured to communicate via the system line 130 with one or more detection devices 120 and/or the detection and alarm panel 110. In an example, the fault isolation controller 212 may send or receive communications via the communications controller 240 indicating operations performed by the detection device 120 such as detection of a short circuit, calculation of impedance, or determination that the short circuit is a false short circuit or an actual short circuit, or any other communication.

Figure 3:
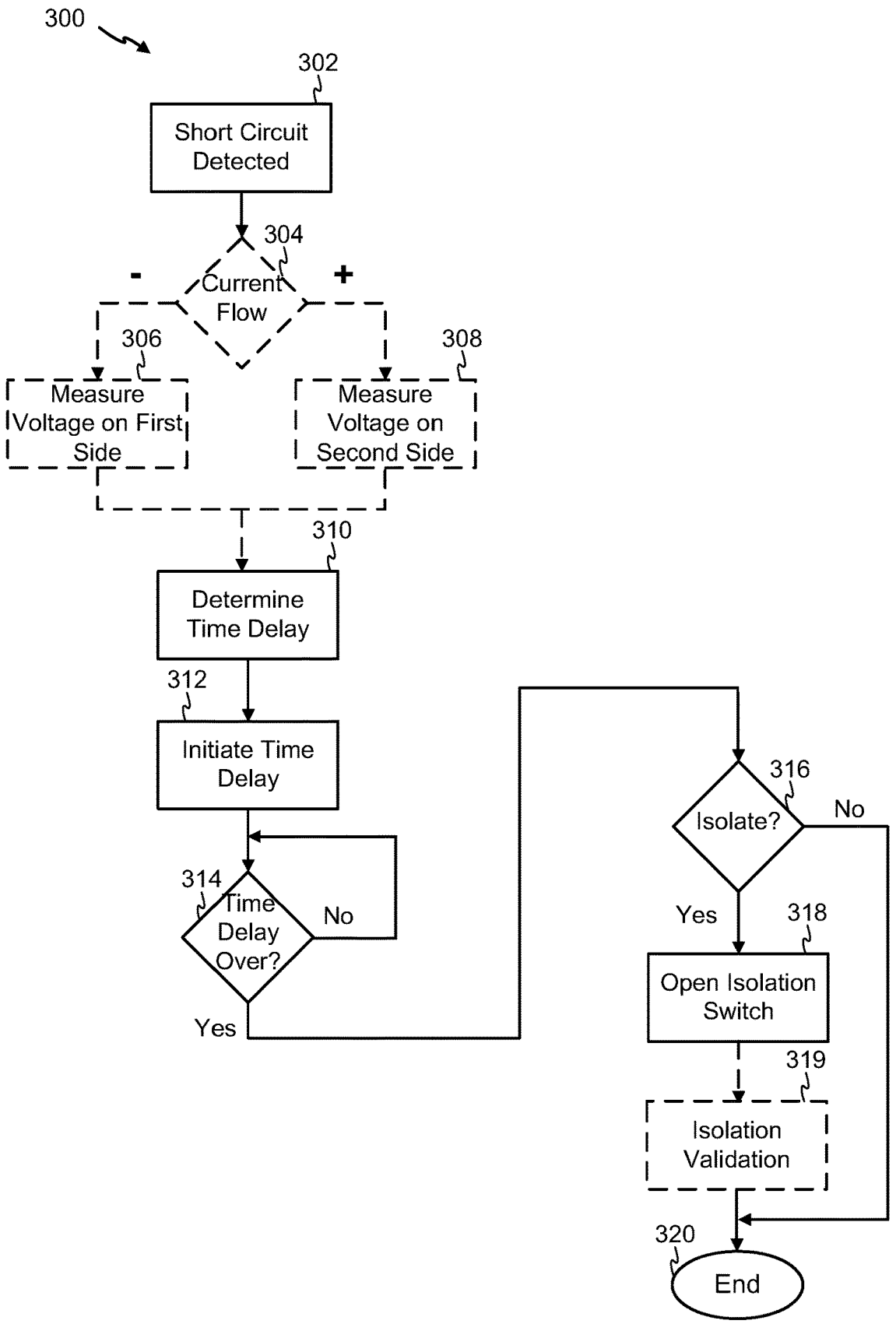
FIG. 3 is a flowchart of an example of logic operations, according to aspects of the present disclosure.

Referring to FIG. 3, an example of logic operations 300 for the fault isolation controller 212 is described. Initially, at 302, the fault isolation controller 212 may receive an indication of a short circuit being detected. As described herein, the fault isolation controller 212 may receive the indication from one or more of the current comparators 226*a*, 226*b* or voltage comparators 234*a*, 234*b*. At 304, the fault isolation controller 212 may optionally determine the direction of current flow. In an example, the direction of current flow may be determined by the fault isolation controller 212 based on whether a current alert signal is received from the current comparator 226*a* or 226*b*. For example, the fault isolation controller 212 may receive a current alert signal from the current comparator 226*a* which indicates that current is flowing towards the communication interface 204 (i.e., a short circuit is on the side of the communication interface 204) In another example, the fault isolation controller 212 may receive a current alert signal from the current comparator 226*b* which indicates that current is flowing towards the communication interface 202 (i.e., a short circuit is on the side of the communication interface 202). Based on the current alert signal, the fault isolation controller 212, at 306, may measure a voltage on a first side (e.g., connection interface 202 side) of the detection device 120 via the voltage monitor 230, or, at 308, may measure a voltage on a second side (e.g., connection interface 204 side) of the detection device 120 via the voltage monitor 232.

At 310, the fault isolation controller 212 may determine a time delay for opening the isolation switches 210. As described herein, the time delay may be determined based on one or more of the current level signal or the voltage level signal (Vadc-bits), and in some examples a differentiation timing coefficient or an offset. In another example, the time delay may be based on values in a LUT.

At 312, the fault isolation controller 212 may initiate the timer 214.

At 314, the fault isolation controller 212 may determine whether the time delay has expired. If the time delay has not expired, the fault isolation controller 212 continues to wait for the time delay to expire. In an example, the time delay may allow other detection devices 120 time to determine if they need to open respective isolation switches. Otherwise, the fault isolation controller 212 may move to 316.

At 316, the fault isolation controller 212 may determine whether to isolate the first side of the system line from the second side of the system line. The determination of isolation may be based on the multiple readings and comparisons (e.g., one or more signals received from the current monitor 220, the voltage monitors 230, 232, the current comparators 226*a*, 226*b*, or the voltage comparators 234*a*, 234*b*) received by the fault isolation controller 212. In an example, if a most recent reading is within one or more detection thresholds, the fault isolation controller 212 may determine that the short circuit detected at 302 is an actual short circuit, and therefore determine to isolate. In another example, if a percentage of abnormal impedance readings are within the detection thresholds, the fault isolation controller 212 may determine that the short circuit is an actual short circuit, and therefore determine to isolate. In another example, if M readings out of a total of N readings, where N and M are integers and M is less than N, are abnormal impedance readings, the fault isolation controller 212 may determine that the short circuit is an actual short circuit, and therefore determine to isolate. In another example, if the readings indicate that the system line 130 transitioned from a short circuit to an open circuit, the fault isolation controller 212 may determine that the short circuit was an actual short circuit, and therefore determine to isolate. For any of these examples, at 318, the fault isolation controller 212 may then send a control signal to the isolation switches 210 to have the isolation switches 210 opened. After opening the isolation switches 210, the operations will end at 320. Otherwise, at 316, the fault isolation controller 212 may determine that the short circuit is a false short circuit and not control signal is sent to the isolation switches 210 to be opened, and therefore the operations end at 320.

Optionally, at 319, after opening isolation switches 210, the operations may include an isolation validation to verify whether the isolation switches 210 were opened based on false positives. For example, if false positives occurred, multiple detection devices 120 may have opened respective isolation switches 210. Accordingly, those detection devices 120 with opened isolation switches 210 may autonomously retest the system line 130 after a validation time period (e.g., 500 μs) from opening the respective isolation switches 210. When this validation time period is reached, the fault isolation controller 212 may validate whether a short circuit is present on the system line 130, as described herein. The fault isolation controller 212 may maintain the isolation switches 210 in an open state if a short circuit is present or may close the isolation switches 210 if no short circuit is present. The operations then end at 320

Figure 4:
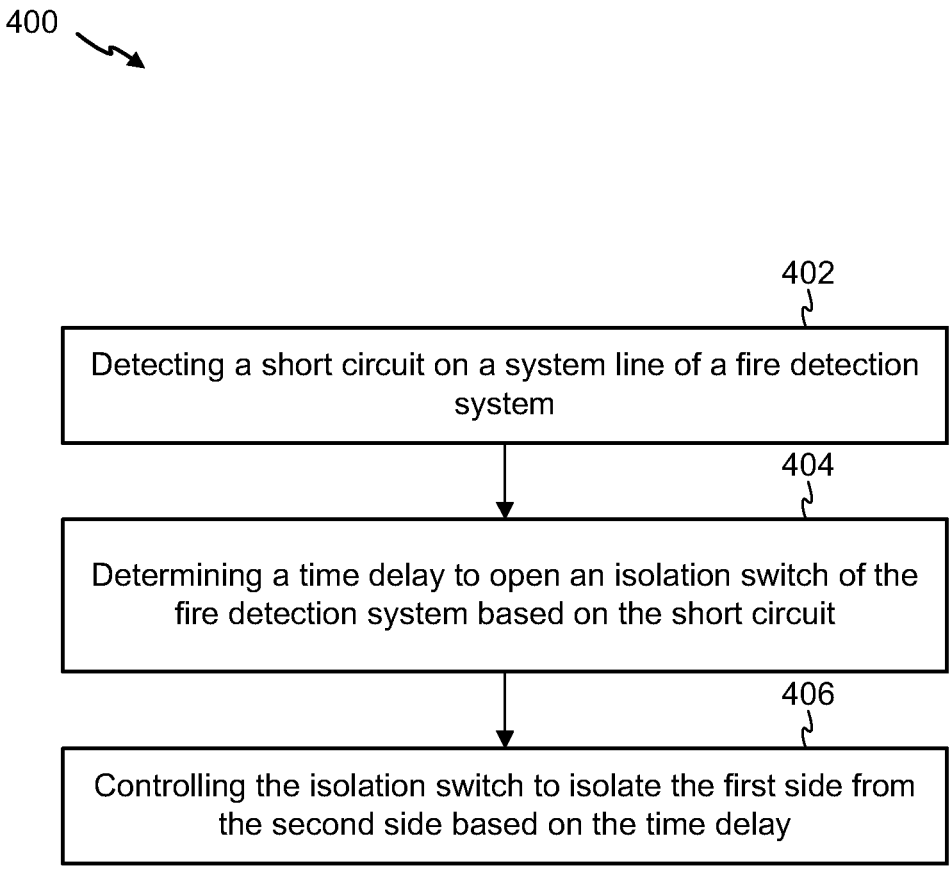
FIG. 4 is a flowchart of an example method, according to aspects of the present disclosure.

Referring to FIG. 4, an example of a method 400 for isolating zones of a fire detection system is disclosed. The method 400 may implement the functionality described herein with reference to FIGS. 1-3 and may be performed by one or more components of the detection device 120 as described herein.

At 402, the method 400 may include detecting a short circuit on a system line of a fire detection system. For example, the fault isolation controller 212 may detect a short circuit on the system line 130 of the fire detection system 100. Detection by the fault isolation controller 212 may be based on one or more signals from the current comparators 226*a*, 226*b*, the voltage comparators 234*a*, 234*b*, the current monitor 220, or the voltage monitors 230, 232.

At 404, the method 400 may include determining a time delay to open an isolation switch of the fire detection system based on the short circuit. For example, the fault isolation controller 212 may determine a time delay to open the isolation switches 210. In an example, the determination of the time delay may be based on one or more of the current level signal or the voltage level signal (Vadc-bits), the differentiation timing coefficient, and/or an offset. In another example, the time delay may be based on a value in a LUT.

At 406, the method 400 may also include controlling the isolation switch to isolate the first side from the second side based on the time delay. For example, the fault isolation controller 212 may send a control signal to the isolation switches 210 to open or remain open such that the communication interface 202 side coupled with the system line 130 is isolated from the communication interface 204 side. In an example, the fault isolation controller 212 may send the control signal (e.g., logic level signal) via switch control line 218 to the isolation switch 210 to open the isolation switch 210.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. The words "module," "mechanism," "element," "device," and the like may not be a substitute for the word "means." As such, no claim element is to be construed as a means plus function unless the element is expressly recited using the phrase "means for."

What is claimed is:

1. An isolation circuit of a fire detection system, comprising:

an isolation switch coupled with a system line of the fire detection system and configured to isolate a first side of the system line from a second side of the system line; and a controller coupled with the isolation switch and configured to:

detect a short circuit on the system line;

determine a time delay to open the isolation switch in response to the short circuit being detected and based on one or more of a current level or a voltage level measured on the system line; and control the isolation switch to isolate the first side from the second side in response to the time delay and based on one or more of a second current level or a second voltage level measured on the system line after the time delay.

2. The isolation circuit of claim 1, wherein the controller is further configured to:

determine the time delay further based on a stored time delay value.

3. The isolation circuit of claim 1, wherein the controller is further configured to:

read a voltage level signal representing the voltage level on the system line in response to detecting the short circuit, wherein the time delay is determined based on the voltage level signal.

4. The isolation circuit of claim 3, further comprising:

one or more voltage monitors coupled between the system line and the controller and configured to measure the voltage level on the system line and to send the voltage level signal to the controller.

5. The isolation circuit of claim 4, wherein the one or more voltage monitors includes a first voltage monitor and a second voltage monitor, and wherein one or more of the first voltage monitor or the second voltage monitor measures the voltage level and sends the voltage level signal to the controller based on a direction of current on the system line.

6. The isolation circuit of claim 1, wherein the controller is further configured to:

determine a first side of the isolation circuit is closest to the short circuit than a second side of the isolation circuit, wherein the time delay is determined further based on a determination of the first side being closest to the short circuit.

7. The isolation circuit of claim 6, further comprising:

a current monitor coupled between the system line and the controller and configured to measure the current level on the system line and to send a current level signal indicating the current level to the controller.

8. The isolation circuit of claim 7, further comprising:

a comparator coupled between the current monitor and the controller and configured to receive the current level signal from the current monitor and provide a current alert signal to the controller when the current level signal satisfies a current level threshold, wherein the determination of the first side being closest to the short circuit is based on the current alert signal provided from the comparator.

9. A method for zone isolation by an isolation circuit of a fire detection system, comprising:

detecting a short circuit on a system line of the fire detection system;

determining a time delay to open an isolation switch of the fire detection system in response to the short circuit being detected and based on one or more of a current level or a voltage level measured on the system line, the isolation switch coupled with the system line and configured to isolate a first side of the system line from a second side of the system line; and controlling the isolation switch to isolate the first side from the second side in response to the time delay and based on one or more of a second current level or a second voltage level measured on the system line after the time delay.

10. The method of claim 9, further comprising:

determining the time delay further based on a stored time delay value.

11. The method of claim 9, further comprising:

determining a first side of the isolation circuit is closest to the short circuit than a second side of the isolation circuit, wherein the time delay is determined further based on the determining of the first side being closest to the short circuit.

12. The method of claim 11, further comprising:

reading a voltage level signal representing the voltage level on the system line in response to detecting the short circuit, wherein the reading the voltage level signal is in response to determining the first side of the isolation circuit is closest to the short circuit.

13. The method of claim 11, further comprising:

determining a direction of current on the system line, wherein the determining the first side of the isolation circuit is closest to the short circuit is based on the direction of the current on the system line.

14. A non-transitory computer-readable medium storing computer executable code for zone isolation by an isolation circuit of a fire detection system, comprising code to:

detect a short circuit on a system line of the fire detection system;

determine a time delay to open an isolation switch of the fire detection system in response to the short circuit being detected and based on one or more of a current level or a voltage level measured on the system line, the isolation switch coupled with the system line and configured to isolate a first side of the system line from a second side of the system line; and control the isolation switch to isolate the first side from the second side in response to the time delay and based on one or more of a second current level or a second voltage level measured on the system line after the time delay.

15. The non-transitory computer-readable medium of claim 14, further comprising code to:

determine the time delay further based on a stored time delay value.

16. The non-transitory computer-readable medium of claim 14, further comprising code to:

determine a first side of the isolation circuit is closest to the short circuit than a second side of the isolation circuit, wherein the time delay is determined further based on a determination of the first side being closest to the short circuit.

* * * * *